US005174342A

United States Patent [19]

Vinciguerra

[11] Patent Number: 5,174,342

[45] Date of Patent: Dec. 29, 1992

[54] DEVICE FOR DRIVING DOBBY RING LEVERS

[75] Inventor: Constantino Vinciguerra, Florence, Italy

[73] Assignee: Nuovopignone-Industrie Meccaniche e Fonderia S.p.A., Florence, Italy

[21] Appl. No.: 839,244

[22] Filed: Feb. 20, 1992

[30] Foreign Application Priority Data

Feb. 28, 1991 [IT] Italy ..... 000520 A/91

[51] Int. Cl.[5] ..... D03C 1/00

[52] U.S. Cl. ..... 139/76; 139/455

[58] Field of Search ..... 139/76, 455, 66 R

[56] References Cited

U.S. PATENT DOCUMENTS 4,452,281 6/1984 Speich .
4,625,767 12/1986 Schwarz .
4,763,697 8/1988 Serturini ..... 139/76
4,905,738 3/1990 Kleiner ..... 139/76

FOREIGN PATENT DOCUMENTS 2943992 5/1981 Fed. Rep. of Germany ..... 139/76

*Primary Examiner*—Andrew M. Falik
*Attorney, Agent, or Firm*—Morgan & Finnegan

[57] ABSTRACT

A device for driving the ring levers that control the keys of a high-speed rotary dobby. In the device, a metal rocker armature is hinged to each lever along the axis of symmetry of the device. The axis passes through the fulcrum about which the levers rock. The levers have at their lower ends teeth that cooperate with corresponding grooves in two digging tracks that move with a reciprocating motion and in mutual opposition perpendicular to the axis of symmetry. The upper rocker armature surface, moreover, cooperates with one of two overlying electromagnets that are arranged symmetrically about the axis of symmetry.

5 Claims, 3 Drawing Sheets

DEVICE FOR DRIVING DOBBY RING LEVERS

BACKGROUND OF THE INVENTION

1. Field of the Invention

This invention relates to a device for driving the ring levers controlling the keys of a high-speed rotary dobby which, by using rocker arms pivoted on said ring levers symmetrically about an axis of symmetry passing through the fulcrum of said levers and made suitably rigid by pairs of electromagnetic systems with one of two dragging grooves rocking in mutual opposition symmetrically about said axis of symmetry, results in considerable compactness, efficiency and constructional simplicity, allows the operating speed to be increased, and enables the dobby to be halted and put into reverse running at any moment, as all idle times are eliminated.

2. Description of the Related Art

As already known from our previous European Patent Appln. publication No. 0 466 234 of Jan. 15, 1992, the device for driving the ring levers controlling the keys of a high-speed rotary dobby comprises, for each lever, a V-shaped spring which has the ends of its two arms inserted into a cavity of said lever facing the lever fulcrum. The spring being mounted preloaded between two fixed shoulders positioned symmetrically about the axis of symmetry of said spring, which passes through said fulcrum of the controlling ring lever. This lever also comprises a second cavity opposite the preceding and cooperating with a slide to which there is hinged the lower end of a sector which rocks symmetrically about said axis of symmetry. The sector comprising in its upper part two valleys arranged symmetrically about said axis of symmetry and cooperating with the lower end of an overlying pusher rod. The pusher rod is hinged at its upper end to an arm projecting from a single dobby shaft made to rock by a control mechanism preferably of cam type synchronized with the dobby modulation mechanism. The pusher rod is slidingly inserted between two pins of a needle selector which cooperates with the port of a programmer by the action of a thrust spring and a return extractor comb to rock by a second control mechanism preferably of cam type and also synchronized with said modulation mechanism.

Such a known device, besides being of evident constructional complexity, has the drawback of a loss of operational effectiveness and reliability with time because of the presence of said V-shaped spring, and in particular presents idle times during which the dobby cannot be put into reverse running and which considerably limit its operational speed. In this respect, in said known device the programmer provides the enabling command to the selector needle, which can then move to cause the forcing member (pusher rod) to operate and transmit the desired movement to the controlling ring lever via the rocking sector; the needle and the rocking sector must then be returned to their rest position with the aid respectively of a further control mechanism and said V-shaped spring to be able to recommence the entire cycle from the beginning, hence the entire time required for these operations which decide whether the ring lever is to be moved represents time lost to the dobby.

SUMMARY OF THE INVENTION

The object of the present invention is to obviate said drawbacks by providing a device for driving the ring levers controlling the keys in a rotary dobby which combines considerable compactness and constructional simplicity with lasting operational effectiveness and reliability at the highest speeds and with a more immediate intervention capacity, and in particular suffers from no condition under which the dobby cannot be put into reverse running.

These and other objects of the invention, as well as the unsatisfactory characteristics of the prior art as noted above, are overcome in great measure through the practice of the invention. Illustratively, a typical embodiment of the invention drives the ring levers control keys of a high-speed rotary dobby. The device has an axis of symmetry that passes through the fulcrum about which the ring levers rock. The device also has a cam control mechanism and a programmer in which, for each ring lever there is, positioned along the axis of symmetry a support hinged in a lower position on the fulcrum about which the ring levers rock. The hinged support, rigid relative to the ring lever also is hinged at its upper end to a metal rocker armature that is positioned perpendicular to the axis of symmetry. The rocker armature, in turn has on each of its downwardly facing ends an engagement. Each of these two teeth is selectively received in respective corresponding grooves of two dragging tracks. These dragging tracks, moreover, are parallel to the armature hinging axis. The dragging tracks enjoy a reciprocating movement perpendicular to the axis of symmetry and are in mutual opposition through the action of a cam control mechanism. Further, the programmer controls two sets of double-winding electromagnets that are mounted symmetrically with respect to the axis of symmetry that cooperate with the respective upper surfaces of the rocker armatures.

The invention is further clarified hereinafter with reference to the accompanying drawings which illustrate a preferred embodiment thereof given by way of non-limiting example in that technical or constructional modifications can be made thereto but without leaving the scope of the present invention.

DESCRIPTION OF THE PREFERRED EMBODIMENTS

Figure 1:
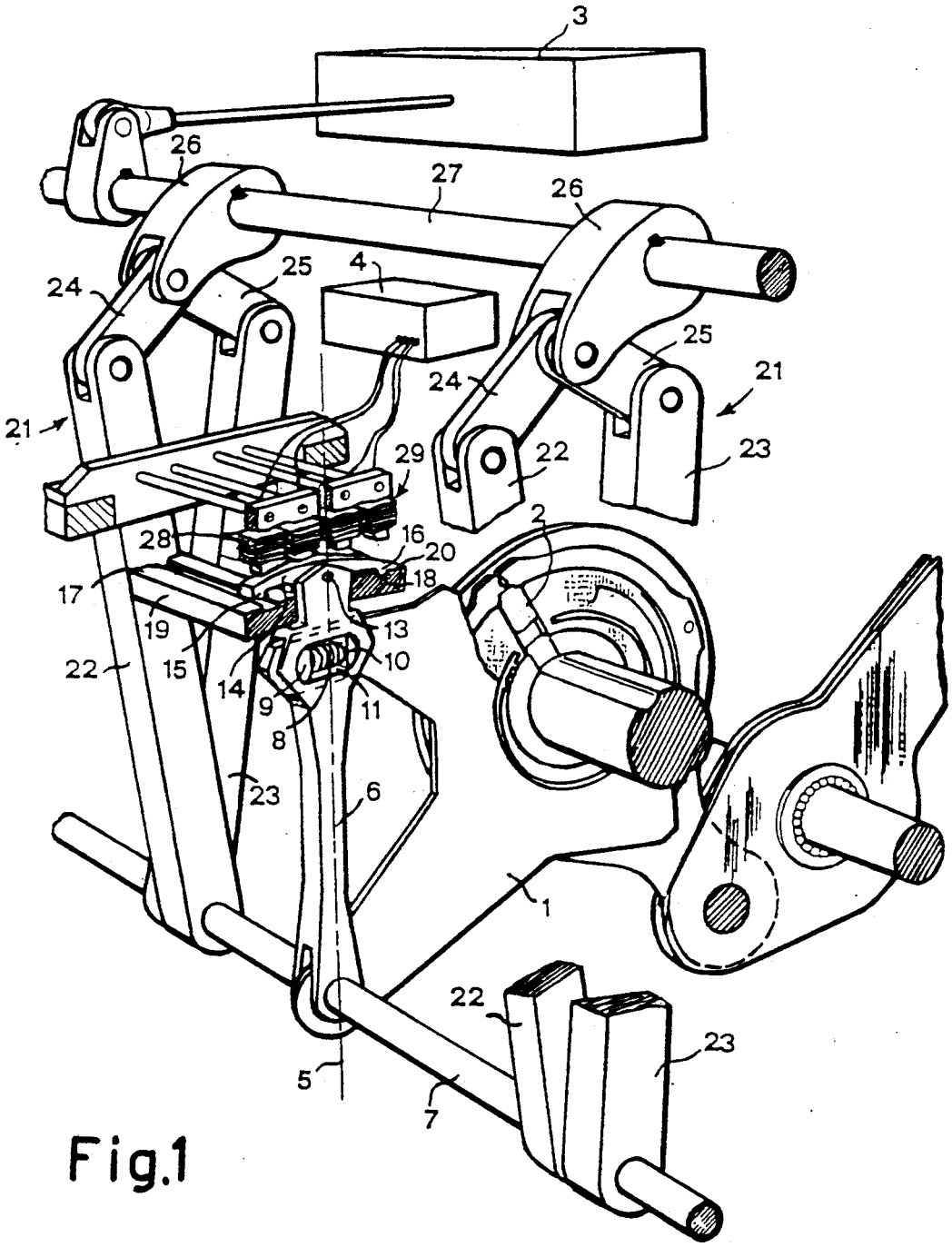
FIG. 1 is a partly sectional partial view of a device for driving the ring levers controlling the keys of a high-speed rotary dobby in accordance with the invention.
Figure 2:
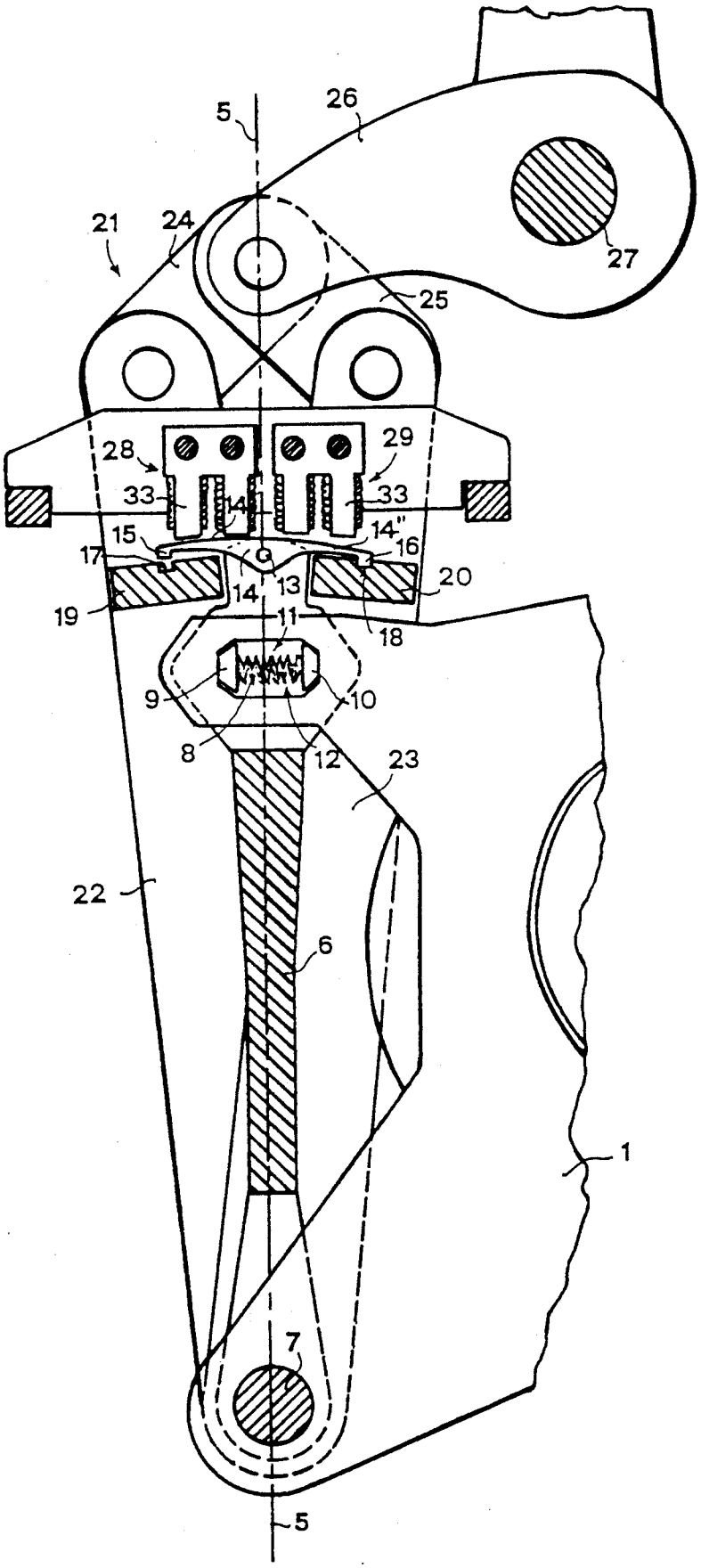
FIG. 2 is a partial front sectional view to an enlarged scale of the device of FIG. 1.

An actual operating system that characterizes the invention is preferably in the form of a rhomboid or approximate parallelogram operating system. The parallelogram is hinged at one end on the same axis as that on which the ring levers are pivoted and it is alternately opened and closed symmetrically with respect to the axis of symmetry for the device. This axis passes through the fulcurm about which said ring levers rock under a cam type control mechanism that acts on the other end of the axis.

The movement of the individual levers towards one or the other side of this axis of symmetry is achieved in a simple manner by a metal rocker armature which is hinged to a lever in a position that is perpendicular to the axis of symmetry. This lever inserts one of two engagement teeth provided at its downwardly facing ends into the respective groove of one of two dragging tracks, or crosspieces, that are mounted rigidly and perpendicular to two of the sides of the parallelogram operating system. As a consequence, the teeth are moved with a reciprocating motion in mutural opposition perpendicular to the axis of symmetry. Insertion of the teeth into the respective grooves is controlled by two double-winding electromagnets that are arranged symmetrically about the axis of symmetry. These electromagnets, when energized by the dobby programmer, attract the upper surface of one and the other end of the rocker armature. As a result, the device is simple, reliable in operation and is activated instantly because energization of an electromagnet results in the immediate attraction of the corresponding underlying side of the armature, thereby forcing the other side of the armature to insert its teeth into the underlying groove in the corresponding dragging track or crosspiece. This action moves the armature and consequently the control ring lever itself. Further in this connection, by creating a wider zone of magnetic influence, the double-winding on the electromagnets ensures that the rocker armature always remains under magnetic influence during its entire travel.

Hence, the device for driving the ring levers controlling the keys of a high-speed rotary dobby, characterized, according to the present invention in that for each ring lever there is a positioned along the axis of symmetry a support hinged in a lower position on the fulcrum about which the ring levers rock. This support is rigid with respect to the related ring lever. The support also is hinged at its upper end to a metal rocker armature that is perpendicular to the axis of symmetry. The rocker armature, as previously mentioned, has downwardly facing ends with two engagement teeth that are arranged to cooperate with the corresponding grooves of two dragging tracks or crosspieces. These dragging tracks are mounted parallel to the hinging axis of the armature and enjoy a reciprocating movement that is perpendicular to the axis of symmetry and in mutual opposition to each other. This motion is regulated through an operating system that is controlled by the cam control mechanism. When the device is energized, the upper surface of the rocker armature responds to the respective one of the two double-winding electromagnets that have been arranged symmetrically about said axis of symmetry and are controlled by the programmer.

According to a preferred embodiment of the present invention, the operating system for the dragging tracks is a parallelogram system of which the two lower sides to which the dragging tracks are rigidly connected, are hinged on the same pivotal axis as the ring levers. The two upper sides of the parallelogram are hinged to the end of an arm that protrudes from a shaft that is driven with a rocking motion by the cam control mechanism.

In order to compensate for the phase displacement between the position of the key and the relative position of the radial locking grooves during the reverse operation of the dobby and during the movement of the key, according to a further characteristic of the present invention, the support for the rocker armature along the axis of symmetry is rigid relative to the respective ring lever. This rigid support is provided by a spring that is preloaded between two shoulder or abutment blocks which are inserted into the ends of corresponding slots in the support and in the ring lever.

Because the metal rocker armature is always attracted either by one or by the other of the double-winding electromagnets, the armature must move inasmuch as it is being dragged by one of the two dragging tracks, thus rocking the armature in mutual opposition. This rocking motion inserts an engagement tooth into the associated groove. To prevent deleterious rubbing between the ends of the pole shoes of the electromagnets and the upper respective surfaces of the armature, according to a further characteristic of the present invention, contact between these elements is prevented. The rubbing is prevented by an extremely small and constant gap that is maintained between these elements throughout the entire arc of movement by suitably shaping and dimensioning the rocking system, the electromagnets and the rocking stroke.

More specifically, these double-winding electromagnets are formed with pole shoes that are dimensioned such that the edges of their ends lie on a single circumference with its center at the fulcrum about which the ring levers rock. The upper surface of the metal rocker armature, moreover, is shaped as a cusp consisting of two circular arcs that are symmetrical about the axis of symmetry and such that each has its center on the fulcrum about which the ring levers rock when shifted to the position assumed after attraction by the associated electromagnet. In this circumstance, the grooves in the dragging tracks are of such a depth that when a tooth of the armature is engaged in a groove, the circular arc of the armature attracted by the electromagnet forms a constant air gap with the electromagnet. Finally, to prevent any possibility of withdrawal of the tooth while it is engaged in the associated groove of the dragging tracks, according to a further characteristic of the invention, the rocker armature is hinged on the support so that the normal to the surfaces of contact between the engaging tooth of the armature and the groove of the relative track into which the tooth is inserted passes through the center of these surfaces and intersects the center of hinging for the rocker armature. In this manner, couples that otherwise would extract the teeth are not generated.

In the figures, the reference numeral 1 indicates one of the ring levers controlling the key 2 of the rotary dobby, and 3 and 4 indicate the dobby cam control mechanism and programmer respectively. Said ring lever 1 comprises, along the axis of symmetry 5, a support 6 which is hinged lowerly on the fulcrum 7 about which the dobby ring levers rock and is made rigid with said ring lever 1 by a spring 8 preloaded between two shoulder or abutment blocks 9 and 10 respectively, inserted into the ends of corresponding slots 11 and 12 of the support 6 and ring lever 1 respectively.

Said support 6 comprises, hinged to its upper end by the pin 13, a metal rocker armature 14 arranged perpendicular to said axis of symmetry 5 and comprising at its downwardly facing ends two engagement teeth 15 and 16 arranged to cooperate with corresponding grooves 17 and 18 in two dragging tracks or crosspieces 19 and 20 arranged parallel to the axis of the pin 13 and moved with reciprocating movement perpendicular to the axis of symmetry 5 and in mutual opposition, by a parallelogram-type operating system 21 consisting of two lower sides 22 and 23, to which said tracks 19 and 20 are perpendicularly fixed and which are hinged on said fulcrum 7 about which the ring levers 1 rock, and two upper sides 24 and 25 respectively, having one end hinged to the corresponding lower sides 22 and 23 and their other ends hinged together and to an arm 26 projecting from a shaft 27 made to rock by said cam control mechanism 3. Said rocker armature 14 cooperates via its upper surfaces 14' and 14'' with one of two double-winding electromagnets 28 and 29 arranged symmetrically about said axis of symmetry 5, and controlled by said programmer 4.

Figure 4:
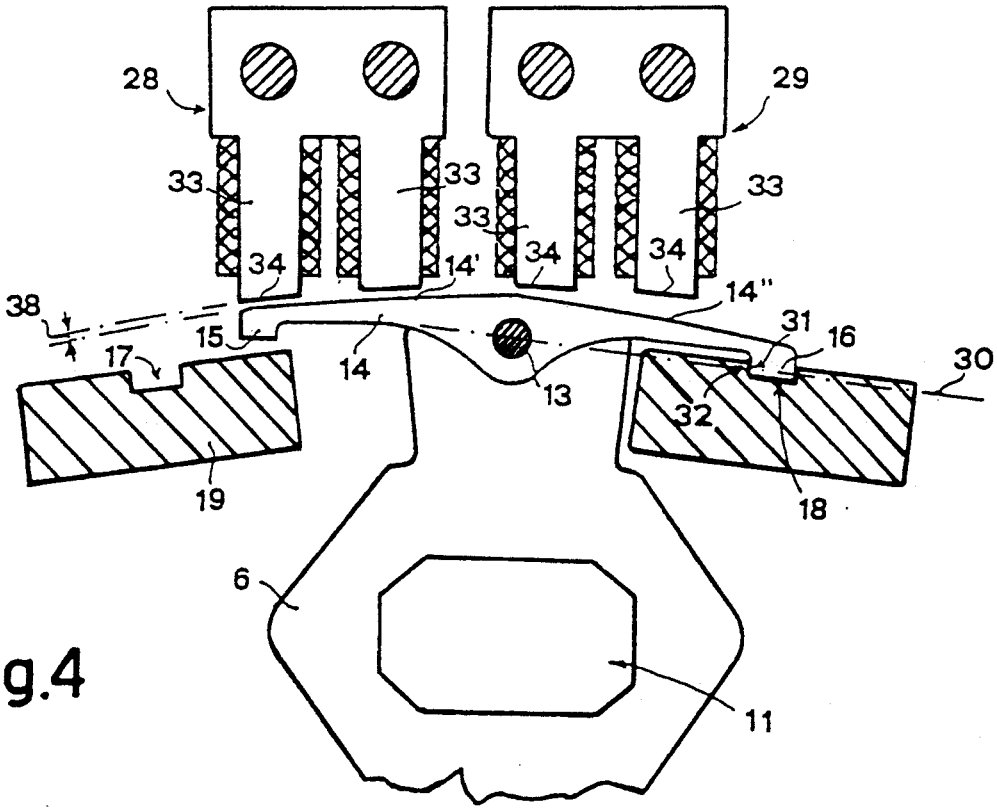

The rocker armature 14 is hinged on said support 6 by the pin 13 such that the normal 30 (see specifically FIG. 4) passing through the center of the contacting surfaces, namely the surface 31 of the engaging tooth 16 of the armature 14 and the surface 32 of the groove 18 of the relative track 20, intersects the center of the pin 13.

Figure 3:
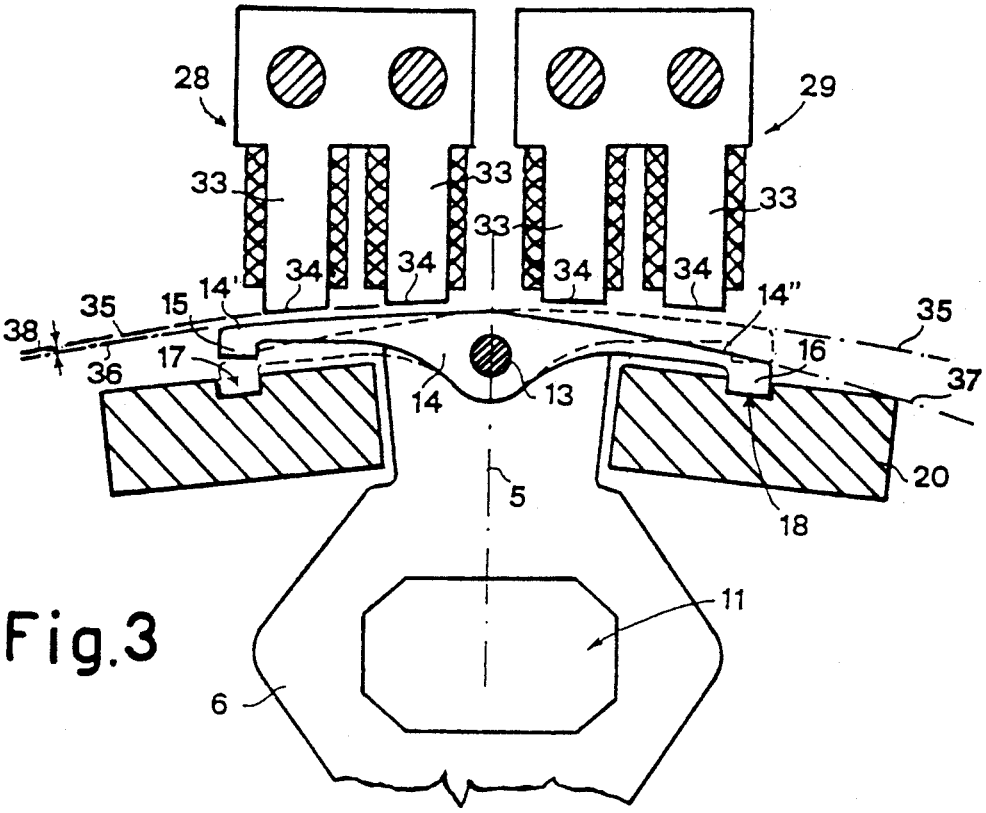
FIGS. 3 and 4 are front sectional views to a very enlarged scale showing details of the device of FIG. 2 which illustrate characteristics of the invention.

Again, said electromagnets 28 and 29 have their pole shoes 33 dimensioned such that the edges 34 of their ends lie on a single circumference 35 (see specifically FIG. 3) having its center on said fulcrum 7 about which the ring levers 1 rock, and the upper surfaces 14' and 14'' of the metal armature 14 are shaped as a cusp formed from two circular arcs 36 and 37 respectively, which are symmetrical about said axis of symmetry 5 and such that each has its center on said fulcrum 7 about which the ring levers 1 rock when in the position it assumes after attraction by the relative electromagnet, as represented in FIG. 3 by the circle 36, which is consequently concentric with said circumference 35 and spaced therefrom by a gap 38 which is maintained constant during the entire travel of the armature 14 rigid with the dragging track 20 (see FIG. 4), said gap 38 being determined by an appropriate depth of the grooves 17 and 18 which limit the downward movement of the engagement teeth 15 and 16 of the metal armature 14 and hence the rocking of said armature. Finally, as is clearly visible in FIG. 4, the use of double-winding electromagnets ensures that the rocker armature 14 remains always under magnetic influence during its entire travel.

I claim:

1. A device for driving the ring levers controlling the keys of a high-speed rotary dobby, having an axis of symmetry passing through the fulcrum about which the ring levers rock and comprising a cam control mechanism, a programmer, a support for each ring lever positioned along the axis of symmetry, said support hinged on one end to the fulcrum about which said ring levers rock and rigid with respect to the relative ring lever, a rocker armature positioned perpendicular to said axis of symmetry, said support being hinged thereto at the other support end, said armature having at each of its ends that face toward the fulcrum a respective one of two engagement teeth, two dragging tracks arranged parallel to said armature hinge and having a pair of grooves formed therein in operative alignment with a respective one of said engagement teeth, an operating system controlled by said cam control mechanism for imparting a reciprocating motion perpendicular to the axis of symmetry to move said teeth in mutual opposition, and, two double-winding electromagnets arranged symmetrically about the axis of symmetry and controlled by said programmer for engaging respective rocker armature surfaces opposite to the fulcrum.

2. A drive device as claimed in claim 1, wherein said operating system for said dragging tracks further comprises a rhomboidal parallelogram system having two adjacent sides to which said dragging tracks are rigidly connected, said sides being hinged on the fulcrum, a shaft driven by said cam control mechanism for rocking motion, an arm protruding from said shaft, said arm being coupled to the other two adjacent sides of said rhomboidal parallelogram.

3. A device as claimed in claim 1, characterized in that said support for said rocker armature provided along said axis of symmetry further comprises a rigid connection with the associated ring lever, a spring preloaded for establishing said rigid connection and two abutment blocks inserted into the ends of said support and in the ring lever on opposite sides of said spring.

4. A drive device as claimed in claim 1, wherein said double-winding electromagnets further comprise pole shoes in which the edges of their ends lie on a single circumference with its center on said fulcrum about which the ring levers rock, the surface of the rocker armature opposite to the fulcrum being shaped as a cusp having two circular arcs symmetrical about said axis of symmetry and having its center on the fulcrum about which the ring levers rock, when in response to said electromagnet, one of said dragging track grooves is engaged by a respective one of said armature teeth, said circular arc of the armature attracted by said electromagnet forms a constant air gap with said electromagnet.

5. A drive device as claimed in claim 1, further comprising the hinge connection between said rocker armature and support structure being arranged to enable a normal to the surfaces of contact between said engaging tooth and said groove of the track associated therewith and into which the tooth is inserted to pass through the center of said surfaces and intersect the center of said rocker armature hinge.

* * * * *